US008117974B2

(12) United States Patent
Ganga et al.

(10) Patent No.: US 8,117,974 B2
(45) **Date of Patent: *Feb. 21, 2012**

(54) BIOMASS ENERGY RECOVERY APPARATUS

(75) Inventors: Raymond C Ganga, Stone Mountain, GA (US); Greg Imig, Suwanee, GA (US); Blake McBurney, Alpharetta, GA (US); Robert Jensen, Portella (PT); John Kerr, Surrey (GB); Steve J Reust, Lafayette, IN (US)

(73) Assignee: The McBurney Corporation, Norcross, GA (US)

( * ) Notice: Subject to any disclaimer, the term of this patent is extended or adjusted under 35 U.S.C. 154(b) by 654 days.

This patent is subject to a terminal disclaimer.

(21) Appl. No.: 12/173,251

(22) Filed: Jul. 15, 2008

(65) Prior Publication Data

US 2009/0031934 A1 Feb. 5, 2009

Related U.S. Application Data

(60) Provisional application No. 60/953,780, filed on Aug. 3, 2007.

(51) Int. Cl.
*F23D 1/00* (2006.01)
*F23J 15/00* (2006.01)

(52) U.S. Cl. ..... 110/263; 110/347; 110/348; 110/203; 110/261

(58) Field of Classification Search ..... 110/196, 110/197, 203, 204, 216, 235, 252, 346, 261, 110/263

See application file for complete search history.

(56) References Cited

U.S. PATENT DOCUMENTS 3,595,181 A * 7/1971 Anderson et al. ..... 110/190
3,861,335 A * 1/1975 Przewalski ..... 110/246
4,509,326 A 4/1985 Jorgensen
4,525,172 A 6/1985 Eriksson
4,616,572 A 10/1986 Berthiller
5,165,903 A 11/1992 Hunt et al.

(Continued)

FOREIGN PATENT DOCUMENTS

EP 1434003 A 6/2004

(Continued)

OTHER PUBLICATIONS

International Search Report and Written Opinion, PCT/US2008/070057, Jul. 15, 2008.

(Continued)

*Primary Examiner* — Kenneth Rinehart
*Assistant Examiner* — David J Laux
(74) *Attorney, Agent, or Firm* — Baker Donelson Bearman Caldwell & Berkowitz, PC

(57) ABSTRACT

An apparatus for extracting energy from fiber introduced as a fuel into a vertically elongated combustion chamber having a suspension burner capable of projecting a flame down the axis of the combustion chamber with a heat collection surface located radially from the flame and below the burner, and an exhaust opening located below the flame and below at least a portion of the heat collection surface, in which the combusted fiber yields a mixture containing hot flue gas and molten ash above the exhaust opening and heat transfers therefrom to the heat collection surface prior to any substantial contact of ash to a surface of the combustion chamber, to yield a mixture containing warm flue gas and non-molten ash, that is thereafter cooled to yield a mixture containing cool flue gas and non-molten ash.

37 Claims, 5 Drawing Sheets

U.S. PATENT DOCUMENTS

| | | | | | |
|---|---|---|---|---|---|
| 5,189,964 | A | | 3/1993 | Rich, Jr. | |
| 5,291,841 | A | | 3/1994 | Dykema | |
| 5,376,354 | A | * | 12/1994 | Fischer et al. | 110/236 |
| 5,406,914 | A | | 4/1995 | Hyppanen | |
| 5,447,703 | A | * | 9/1995 | Baer et al. | 110/342 |
| 5,501,160 | A | | 3/1996 | Goldman et al. | |
| 5,590,610 | A | | 1/1997 | Sanbonmatsu | |
| 6,058,855 | A | | 5/2000 | Ake | |
| 6,202,574 | B1 | | 3/2001 | Liljedahl | |
| 6,615,751 | B1 | | 9/2003 | Sorensen et al. | |
| 7,007,616 | B2 | | 3/2006 | Abrams et al. | |
| 7,077,069 | B2 | | 7/2006 | Oomura | |
| 7,806,090 | B2 | * | 10/2010 | McBurney et al. | 110/342 |
| 2004/0134395 | A1 | | 7/2004 | Eberhardt et al. | |
| 2007/0020375 | A1 | | 1/2007 | Jansen et al. | |
| 2009/0044737 | A1 | | 2/2009 | Ganga | |

FOREIGN PATENT DOCUMENTS

| | | | |
|---|---|---|---|
| FR | 2673702 | A1 | 9/1992 |
| FR | 2761458 | A | 10/1998 |
| FR | 2795161 | A | 12/2000 |
| JP | 14-155287 | A | 5/2002 |
| JP | 16-205161 | A | 7/2004 |
| JP | 18-132811 | A | 5/2006 |
| WO | 9844297 | | 10/1998 |

OTHER PUBLICATIONS

International Preliminary Report on Patentability, PCT/US2008/070067 (Oct. 12, 2010).

Written Opinion, PCT/US2008/070057 (Feb. 9, 2010).

McBurney Project File; "Large Scale Wood Waste Fired Power Generating Plant"; The McBurney Corporation, P.O. Box 1827, Norcross, GA 30091 (Mar. 1998).

McBurney Project File; "Wood Fired Steam Plant Provides Thermal Energy for Specialty Basket Manufacturer"; The McBurney Corporation, P.O. Box 1827, Norcross, GA 30091 (Mar. 1998).

McBurney Project File; "Wood Fired Steam Plant Provides Thermal Energy for Romanian Sawmill"; The McBurney Corporation, P.O. Box 1827, Norcross, GA 30091 (Mar. 1998).

Engineering Services; McBurney brochure; The McBurney Corporation, P.O. Box 1827, Norcross, GA 30091 (prior to Aug. 3, 2007).

Construction Services; McBurney brochure; The McBurney Corporation, P.O. Box 1827, Norcross, GA 30091 (prior to Aug. 3, 2007).

Maintenance & Repair; McBurney brochure; The McBurney Corporation, P.O. Box 1827, Norcross, GA 30091 (prior to Aug. 3, 2007).

McBurney Field Services; McBurney brochure; The McBurney Corporation, P.O. Box 1827, Norcross, GA 30091 (prior to Aug. 3, 2007).

McBurney Energy Systems; Modul-Pak II Boiler; McBurney brochure; The McBurney Corporation, P.O. Box 1827, Norcross, GA 30091 (for purposes of citation, prior to Aug. 3, 2007).

Modul-Pak brochure; Industrial Boiler, Co, Inc., PO Drawer 2258, Thomasville, GA 31799 (for purposes of citation, prior to Aug. 3, 2007).

Larsen et al., "Relations Between Combustion, Deposition, Flue Gas Temperatures and Corrosion in Straw-Fired Boilers," 2nd World Conference on Biomass for Energy, Industry and Climate Protection, Rome, Italy (May 10-14, 2004).

* cited by examiner

BIOMASS ENERGY RECOVERY APPARATUS

This application claims the benefit under 35 US 120 of U.S. Provisional Patent Application Ser. No. 60/953,780, filed Aug. 3, 2007.

STATEMENT REGARDING JOINT RESEARCH AGREEMENT

The claimed invention was made by or on behalf of The McBurney Corporation and Tate & Lyle Ingredients, Americas, Inc., as parties to a joint research agreement that was in effect on or before the date the claimed invention was made as a result of activities undertaken within the scope of the joint research agreement.

TECHNICAL FIELD

The present invention relates to combustion devices for extracting energy from fuels. More particularly, the present invention relates to energy recovery apparatus and system for combusting biomass materials.

BACKGROUND OF THE INVENTION

There are a variety of fuel sources for extracting energy for useful work, such as generation of steam, heat, and electricity, for example. Fuel sources generally are cost components that incur expenses in procurement, processing for use as a fuel, transport, storage, and use. Such fuels include coal, natural gas, and the like.

Alternative fuel sources include waste by-products from manufacturing and processing, for example, fibers from agricultural processing. Use of waste provides the economic benefit of extraction of energy from a material that otherwise may have disposal costs and no other practical benefit. Fiber is used herein to refer to any material derived from a member of the plant kingdom that has been physically separated or at least partially depleted (i.e., to less than about 40% d.s.b. total) of sugars, starch, protein, and germ. Separated fiber includes, but is not limited to, husks, hulls, nutshells, leaves, trunks or stalks, branches, roots, sprouts, chaff and dust. Fiber can be burned or combusted to provide energy; depending on the plant source, the fiber's composition, and its water content, it typically has a higher heating value (HHV) of about 7000-10,000 BTU/lb (dry basis). Other plant materials, such as corn germ, can have HHVs as high as 15,000 BTU/lb (dry basis). Therefore, theoretically, fiber or other plant material could be burned in order to wholly or partially power industrial processes, such as a milling process which produces fiber as a coproduct.

However, fiber has generally not been used as an energy source for a number of reasons. First, most fiber contains relatively high levels of ash (inorganic ions), such as elementary or compounds of phosphorous, calcium, magnesium, sodium, and potassium. For example, typical corn kernel fiber contains about 4% d.s.b. ash, of which phosphorous is the most common element (total ash containing about 40 wt % $P_2O_5$). Fiber ash generally has a relatively low fusion or melting point, meaning that at higher temperatures the ash is molten and will form slag on refractory or metallic surfaces of a furnace, boiler, or flue gas stack if the molten ash contacts these surfaces. Ash at temperatures below its melting point is generally in the form of small, generally irregularly shaped, solid particles.

Another concern regarding fiber combustion is fuel-bound nitrogen. Fiber typically contains some residual proteins, which contain nitrogen. Combustion in air or under another oxygenated atmosphere of a fuel containing nitrogen will lead to formation of nitrogen oxides (NOx). NOx emissions are generally discouraged under the regulatory climates prevailing in the developed world. NOx emissions can be partially reduced through good combustion practices. NOx can be further reduced from flue gas by various known means, but these involve further expenses for equipment, maintenance, and operations.

There are different systems for processing biomass materials and fibrous materials for extracting useful components. Generally the processes are either wet or dry. For example, in wet mill processing of corn, the corn is soaked in water and milled to form a mash. The process then separates the mash into fiber, starch, protein, corn germ, and byproduct fibrous materials. The process thereby separates the valuable and waste byproducts of the corn. The waste byproducts lack food or other commercial value, but have inherent BTU value. Dry separation of biomaterials is generally not as effective as wet processing in separating desirable components from waste products.

However, a drawback to wet mill processing is that the waste products are wet and therefore difficult to recover energy. By comparison, wood chips are usually readily combustible. However, other waste byproducts have decreasing commercial value and increasing difficulty in extracting energy. For example, rice hulls contain high quantities of silicate. Other materials are difficult to burn or contain hazardous material. The value of the waste product decreases as the difficulty to recover energy from the waste byproduct increases.

Slagging also increases the difficulty of recovering energy from waste byproducts. Slag is a built-up material formed as a byproduct of combustion. Slag results where the noncombustible material softens or melts into a molten sticky layer that builds up on the interior walls of the combustion unit. Slag is difficult to extract and remove.

Accordingly, there is a need in the art for an improved combustion system and apparatus for extracting energy from fiber that has minimal risk of slagging and relatively low NOx emissions. It is to such that the present invention is directed.

SUMMARY OF THE INVENTION

The present invention meets the needs in the art by providing an apparatus and system for energy recovery from waste biomass fiber used as a fuel. One embodiment relates to an apparatus that extracts energy from a biomass fuel or fiber, comprising a vertically elongated combustion chamber having a top end, a flame containment portion, and a lower end portion, and a supply of a biomass fuel for combusting in the combustion chamber. At least one suspension burner mounts at the top end of the combustion chamber and communicates with the supply of the biomass fuel. The burner is configured for projecting a flame down a longitudinal axis of the flame containment portion of the combustion chamber. A wall of the combustion chamber defines a heat transfer apparatus having at least a portion of a heat collection surface located radially from the flame. An exhaust opening in a side wall of the combustion chamber is vertically spaced from a distal end of the flame containment portion and vertically spaced lower than a substantial majority of the heat collection surface. Biomass fuel combusted within the combustion chamber yields a mixture above the exhaust opening, containing hot flue gas and entrained molten ash. The hot flue gas is at about a combustion temperature that is about the temperature of the flame. Heat from the hot flue gas transferring to the heat collection surface substantially by radiation yields a mixture of warm flue gas and non-molten ash. The warm flue gas is at a second temperature in a range from about an ash fusion temperature to about an ash molten temperature, the temperatures in the range lower than the combustion temperature. A temperature modulator communicates with a supply of a cold gas and meters the cold gas into the combustion chamber proximate to the exhaust opening. The cold gas cools the warm flue gas and yields a mixture containing cool flue gas and non-molten ash. The cool flue gas is at a third temperature in a range from ambient temperature to about the ash fusion temperature, with the third temperature lower than the second temperature. The cool flue gas communicates from the combustion chamber through the exhaust opening.

In another aspect, the present invention is directed to a method for extracting energy from a biomass fuel, comprising the steps of:

(a) introducing a biomass fuel through a burner attached to a top end of a vertically elongated combustion chamber, the burner configured for projecting a flame down a longitudinal axis of a flame containment portion of the combustion chamber;

(b) combusting the biomass fuel within a flame in the flame containment portion of the combustion chamber to yield a mixture containing hot flue gas and entrained molten ash;

(c) transferring heat from the hot flue gas to a heat transfer apparatus having at least a portion of a heat collection surface located radially from the flame in the flame containment portion of the combustion chamber substantially by radiation prior to any substantial contact of molten ash to a surface of the combustion chamber to yield a mixture of warm flue gas and non-molten ash, the warm flue gas at a second temperature in a range from about an ash fusion temperature to about an ash molten temperature, the range lower than the combustion temperature;

(d) inserting into the combustion chamber a cold gas proximate an exhaust opening in a side wall of the combustion chamber vertically spaced from a distal end of the flame containment portion and vertically spaced lower then a substantial majority of the heat collection surface, the cold gas to cool the warm flue gas and yield a mixture containing cool flue gas and non-molten ash, the cool flue gas at a third temperature in a range from ambient temperature to about the ash fusion temperature, the third temperature lower than the second temperature; and (e) communicating the cool flue gas from the combustion chamber through the exhaust opening.

Objects, advantages, and features of the present invention will become readily apparent upon reading the following detailed description in conjunction with the drawings and the appended claims.

DETAILED DESCRIPTION

Figure 1:
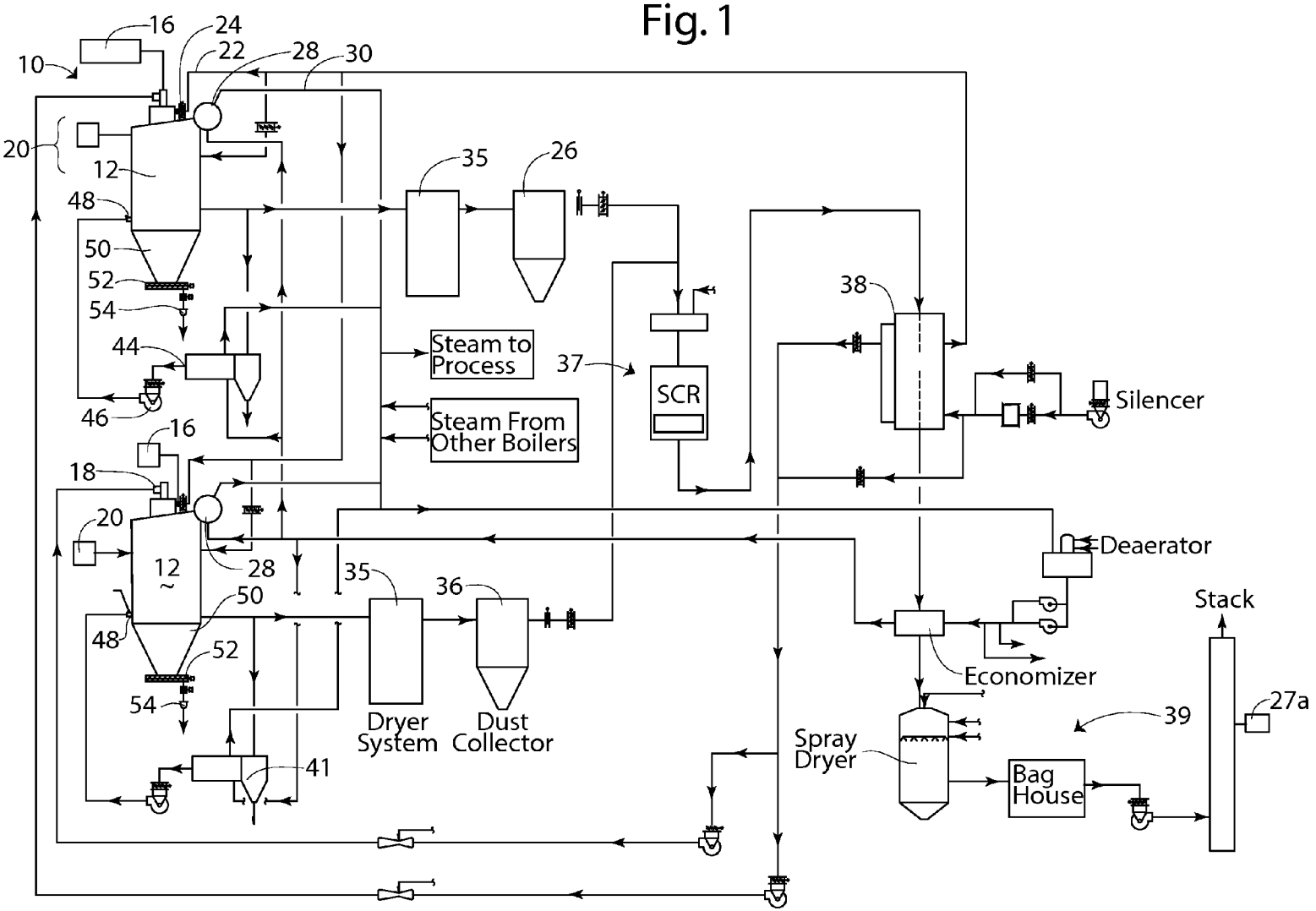
FIG. 1 is a schematic illustration of a biomass energy recovery system according to the present invention.

With reference to the drawings, in which like parts have like reference numerals, FIG. 1 illustrates a schematic diagram of a biomass energy recovery system 10 in accordance with the present invention. The system 10 includes at least one combustion chamber or boiler 12. The boiler 12 is a down flow-type having a burner 14 mounted at a top end and that communicates with a supply 16 of a biomass used for combustion. The burner 14 includes a primary air supply 18. The primary air supply 18 communicates air that intermixes with the biomass materials or fuel that flows through the burner 14 into a flame portion generally 20 of the boiler 12. A secondary airflow inlet 22 includes a damper 24 for modulating the flow of secondary air into the flame contained within the boiler 12. A tertiary air inlet 26 communicates with a supply of heated air for input into a lower portion of the boiler 12, as discussed below. In one embodiment, an inlet 27 communicates with a supply of a combustion additive for modifying the properties of ash generated by the combustion of biomass fuel, as discussed below. A sensor 27*a* monitors NOx concentrations in the flue gas for operatively metering the insertion of the combustion additive. The sidewall of the boiler 12 is defined by a plurality of parallel water tubes that communicate with a steam drum 28. The steam drum 28 generates high quality, high temperature, high pressure steam that communicates through an outlet and pipes generally 30 to supply industrial processes that conventionally rely on steam. A flue gas exit 32 communicates flue gas from the boiler 12 for communication to a dryer system 35, dust and particulate collectors 36 and subsequently to downstream processes for emission reduction treatment generally 37, use 38 of the heated air for heating or other processes requiring heated air, and discharge 39 to final emissions control equipment.

The biomass energy recovery system 10 in one embodiment illustrated in FIG. 1 includes a bypass 40 for communicating a portion of the flue gas to a heat exchanger 41. The heat exchanger 41 provides low pressure saturated steam for downstream industrial processing, as well as a low temperature processed flue gas that communicates through an outlet 44. A damper 46 controls the flow of the low temperature flue gas (or flue gas recirculation air) back to the boiler 12 through an inlet 48, for a purpose discussed below.

The biomass energy recovery system 10 in another embodiment includes a heat exchanger for superheating steam for downstream industrial processes.

The lower end of the boiler 12 includes a hopper generally 50 that communicates ash and particulate debris to an auger conveyer 52 for communication to ash handling devices generally 54 including an ash pit and ash silo.

The biomass energy recovery system 10 according to the present invention is modular. The term "modular" as used herein refers to the combustion chamber or boiler 12 that is shop-built or manufactured at a first site, such as a manufacturing plant, and transported as an assembly to a second remote site for installation in a biomass energy recovery system. Such boilers in accordance with the present invention can range up to about 80 feet with outside dimensions (cross-sectional) defined by the perimeter walls of about 12 feet by 12 feet. It is to be appreciated that two or more such biomass energy recovery systems 10 may be linked together as illustrated in FIG. 1 depending on the capacity of steam or heat output required for downstream manufacturing processes in a manufacturing facility.

Figure 2:
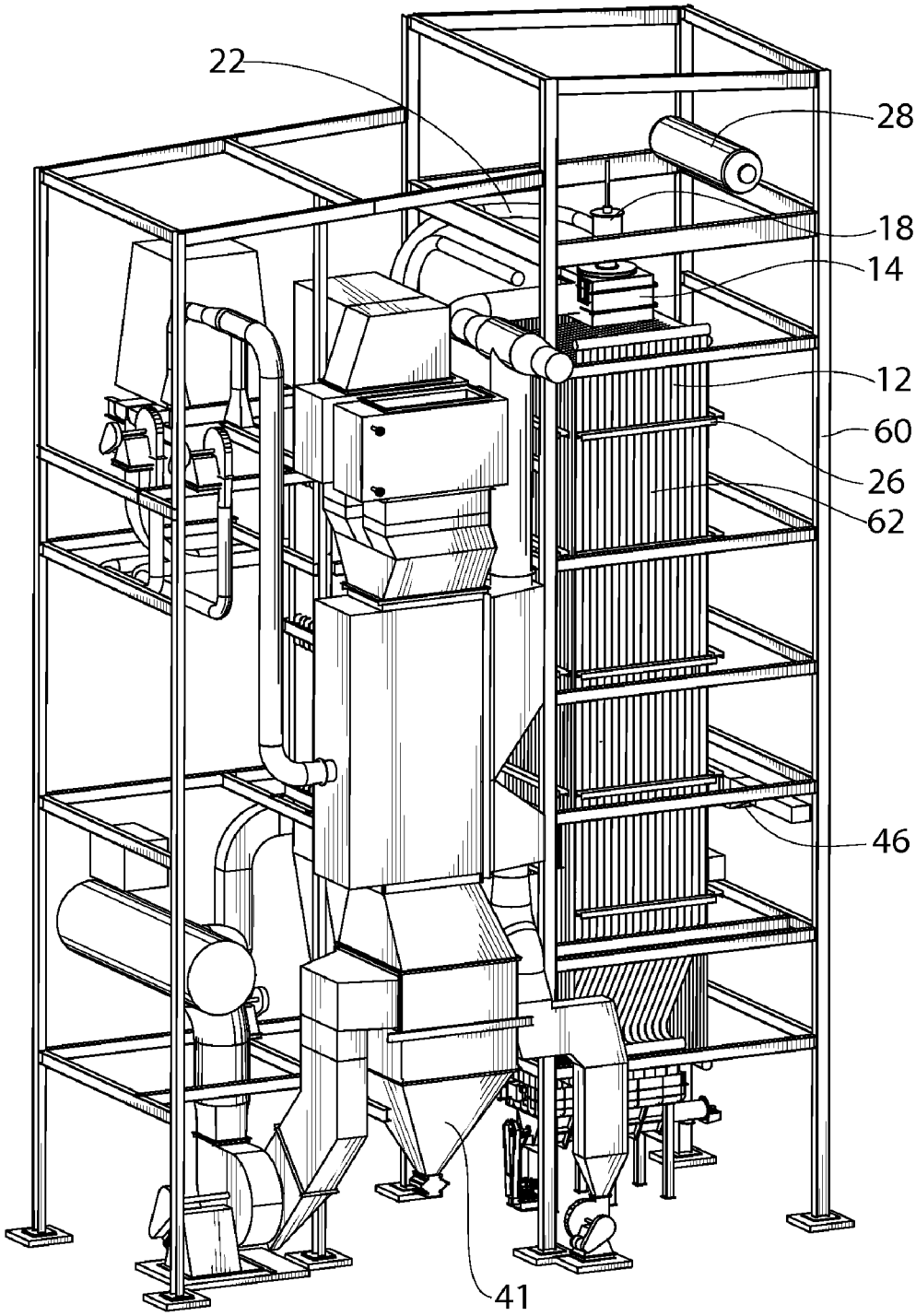
FIG. 2 illustrates in perspective view the biomass energy recovery apparatus depicted in FIG. 1.

FIG. 2 is a perspective view of the biomass energy recovery apparatus 10 depicted in FIG. 1. The boiler 12 mounts vertically within a steel frame generally 60. The biomass energy recovery system 10 provides a gas-tight envelope for extraction of thermal energy from biomass fuel material. The primary air supply 18 intermixes with the biomass supply 16 for carrying or conveying the biomass into the burner 14. The secondary air inlet 22 communicates with a supply of heated air. In one aspect, the secondary air inlet 22 communicates with flue gas that has been treated for emission reduction (generally 37 in FIG. 1) which flue gas communicates from the boiler 12 through the flue gas exit 32. The secondary air inlet 22 communicates a supply of secondary air into the wind box of the burner 12 for shaping the flame of the burning biomass in the upper or flame portion 20 of the boiler 12. The tertiary air inlet 26 communicates with a header having a plurality of over fire air nozzles that communicate air into the interior of the boiler 12. In the illustrated embodiment, the tertiary air inlet communicates with the supply of treated flue gas for the secondary air inlet 22. The tertiary air stages the flame of the burning biomass and air within the combustion chamber. The flame of burning biomass includes entrained ash. The heat 12 is given up to the walls of the boiler formed of water tubes generally 62. The water tubes define a heat collection surface located radially from the flame. The tubes communicate the heat to the water in the tubes. The heated water forms steam that rises upwardly into the steam drum 28 where the steam is collected and communicated to down stream processes requiring superheated steam.

Figure 3:
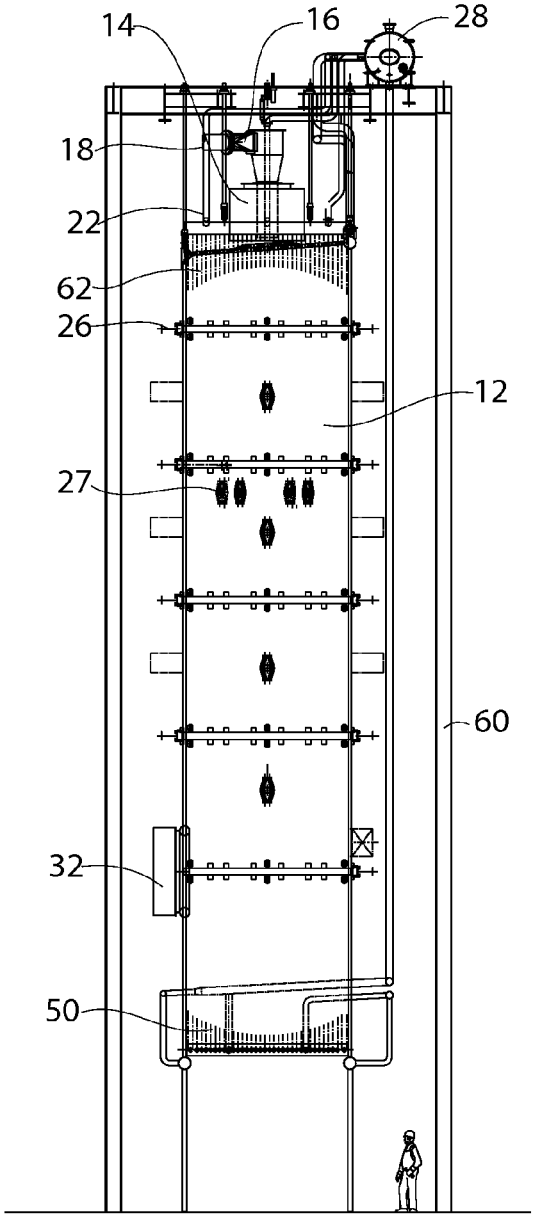
FIG. 3 illustrates in side elevation view a boiler in the biomass energy recovery apparatus illustrated in FIG. 2.
Figure 4:
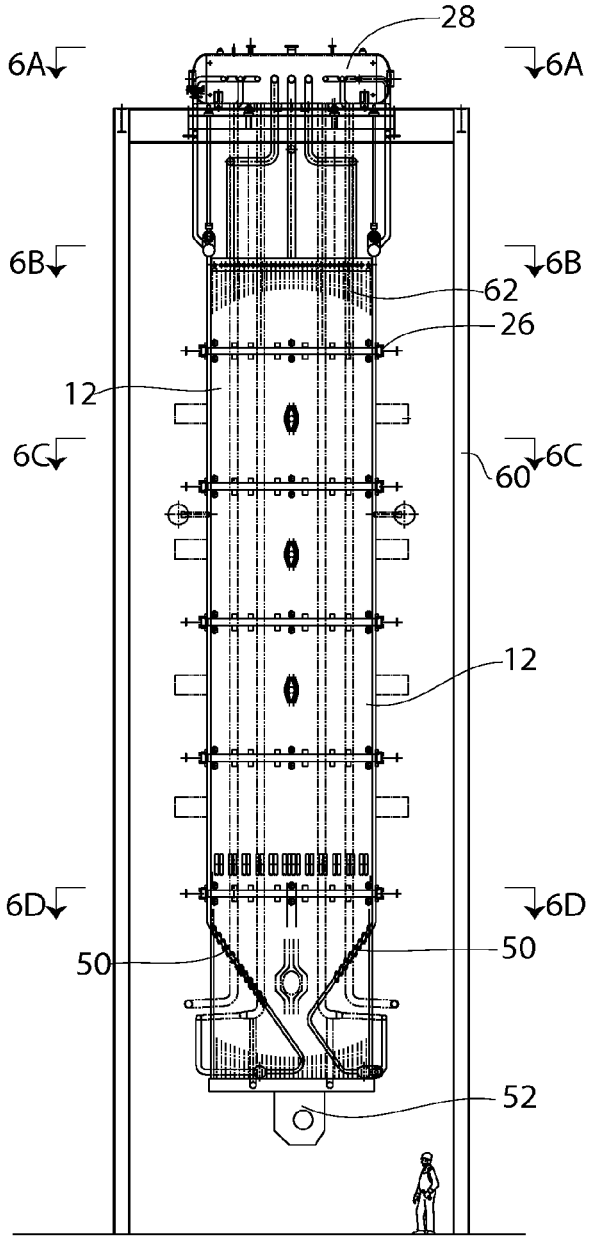
FIG. 4 illustrates in front elevation view the boiler in the biomass energy recovery apparatus shown in FIG. 2.
Figure 5:
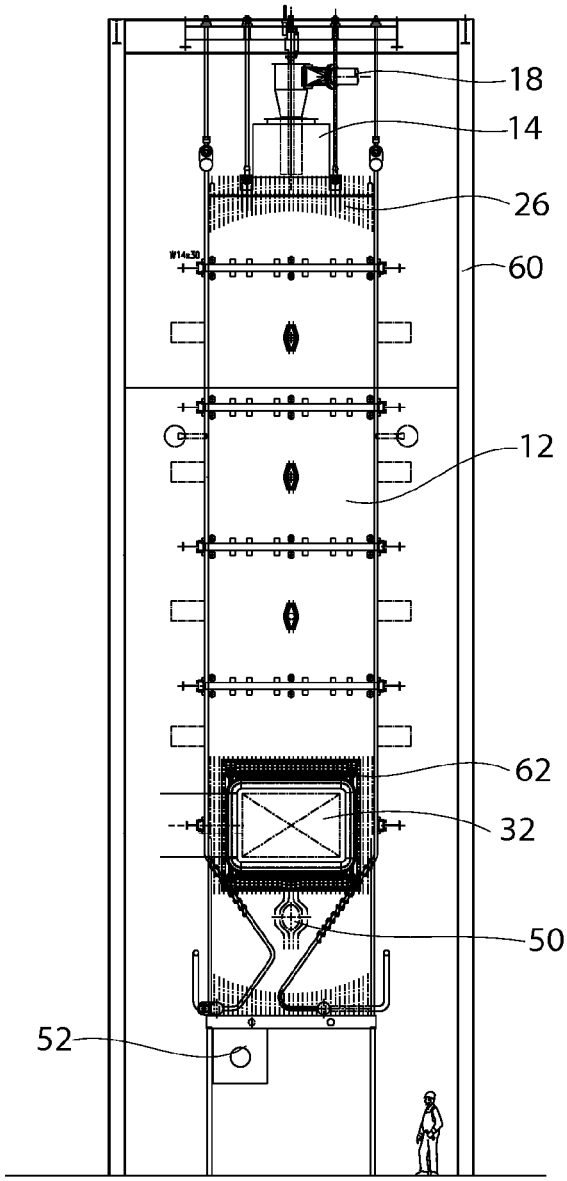
FIG. 5 illustrates in back elevation view the boiler in the biomass energy recovery apparatus shown in FIG. 2.

FIG. 3 illustrates the boiler 12 in side elevation view, FIG. 4 illustrates the boiler in front elevation view, and FIG. 5 illustrates the boiler in rear elevation view, partially cut-away to illustrate interior structure. The temperature of the flue gas proximate the flue gas outlet 32 is approximately 760° C., in the illustrated embodiment. The cool flue gas exits through the flue gas outlet 32. The flue gas outlet 32 is vertically spaced from an approximate end of the flame containment portion 20 and vertically spaced lower of a substantial majority of the heat collection surface. A portion of the cool flue gas communicates through the bypass 40 to the heat exchanger 41. Low temperature cold flue gas exits the heat exchanger 41 through an outlet 44 to the flue gas recirculation header or inlet 48. The flue gas recirculation air provides quenching air that communicates into the lower portion of the boiler 12 proximate the flue gas outlet 32 to maintain the cool flue gas temperature approximately at a pre-selected temperature. In the illustrated embodiment, the temperature of the cool flue gas that communicates through the flue gas outlet 32 is at a temperature of approximately 1200° F.

At the flue gas outlet 32, the heated gas within the boiler 12 changes directional flow from generally vertically downward to horizontal, and communicates outwardly to downstream processes requiring superheated air. The entrained ash however is not molten due to the recirculation of low temperature flue gas recirculant air communicated into the lower portion of the boiler. The ash is not molten, but solid particulate. The ash falls out of the laterally moving flue gas into the hopper 50 where it is collected in an auger conveyer 52 for communication to the ash treatment devices 54.

Figure 6A:
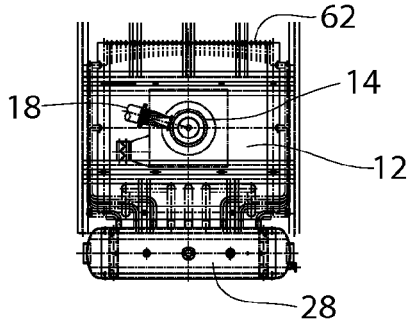
FIGS. 6A, 6B, 6C, and 6D illustrate in plan view cross-sections of the boiler taken along lines 6A-6A, 6B-6B, 6C-6C, and 6D-6D, respectively, of FIG. 4.
Figure 6B:
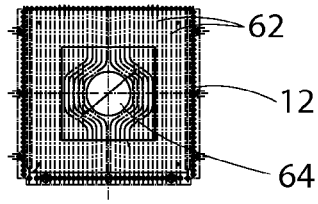
Figure 6C:
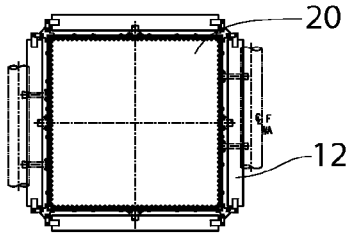
Figure 6D:
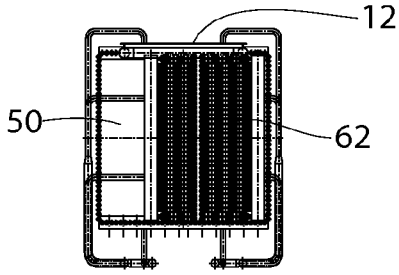

FIGS. 6A, 6B, 6C, and 6D illustrate in plan view cross-sections of the boiler 12 shown in FIG. 4. FIG. 6A illustrates a top plan view of the boiler 12 taken along line 6A-6A of FIG. 4, including the steam drum 28, the water tubes 62 that communicate through headers to the steam drum, the burner 14, and the primary air inlet 18. FIG. 6B illustrates the boiler in cross-sectional view taken along line 6B-6B of FIG. 4 showing the water tubes 62 at the top of the boiler with an opening 64 defined for the burner 14. FIG. 6C illustrates the boiler in cross-sectional view taken along line 6C-6C of FIG. 4 showing the flame portion 20 of the boiler with the side walls made of the water tubes 62. FIG. 6D illustrates the boiler in cross-sectional view taken along line 6D-6D of FIG. 4, illustrating a portion of the water tubes 62 and a portion of the hopper plates 50 in the bottom of the boiler.

Figure 7:
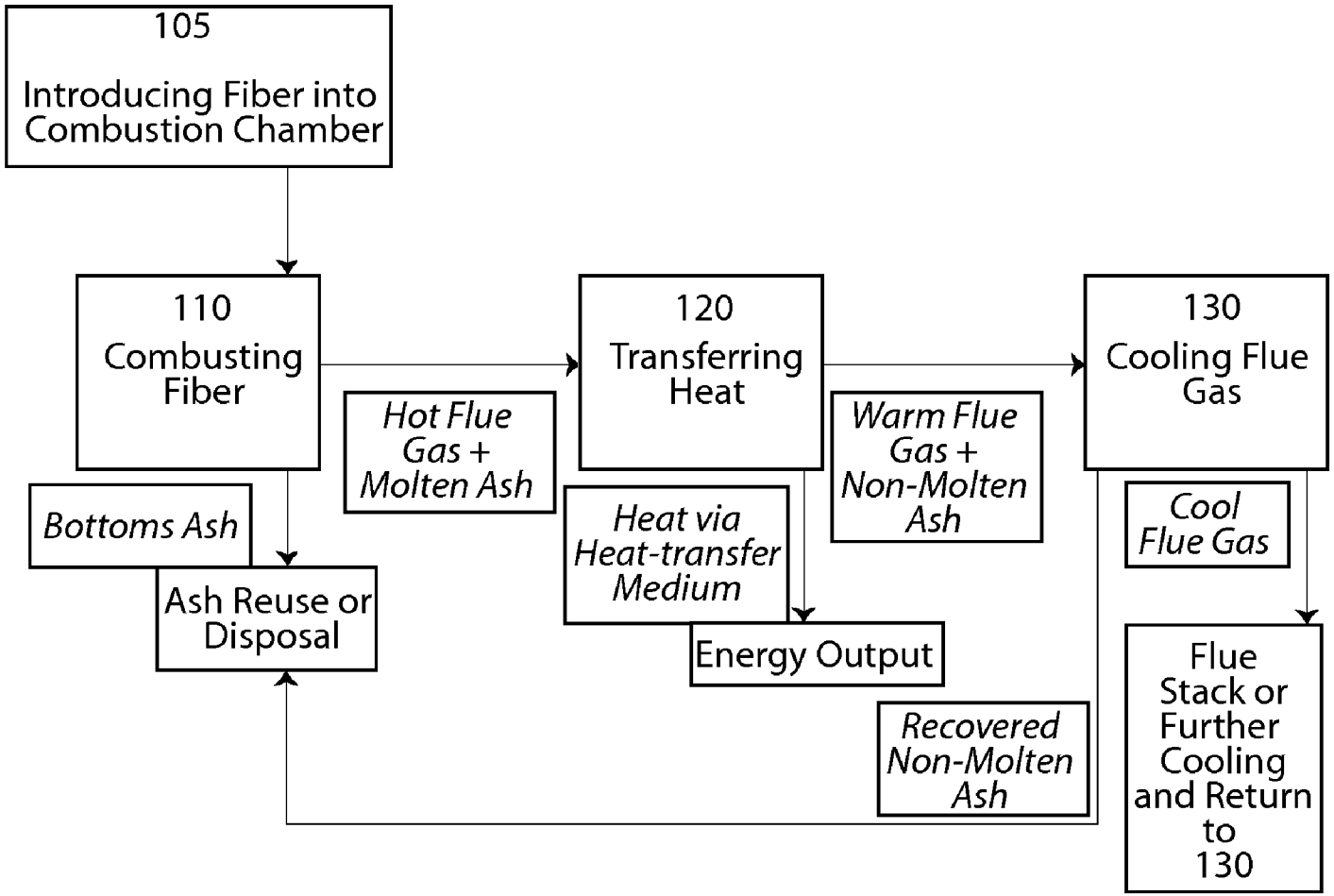
FIG. 7 is a schematic diagram of the biomass energy recovery process in accordance with the present invention.

Turning to FIG. 7, in one embodiment, the present invention relates to a method for extracting energy from fiber, comprising 105 introducing the fiber into a vertically elongated combustion chamber having i) at least one suspension burner at the top of the combustion chamber which is capable of projecting a flame down the axis of the combustion chamber, ii) a heat transfer apparatus having at least a portion of a heat collection surface located radially from the flame and below the burner, and iii) an exhaust opening located below the flame and below at least a portion of the heat collection surface; 110 combusting the fiber to yield a mixture containing hot flue gas and molten ash above the exhaust opening; 120 transferring heat from the hot flue gas to at least a portion of the heat collection surface substantially by radiation prior to any substantial contact of ash to a surface of the combustion chamber, to yield a mixture containing warm flue gas and non-molten ash; and 130 cooling the warm flue gas with cold gas, to yield a mixture containing cool flue gas and non-molten ash. This process carried out in the illustrated biomass energy recovery system 10 can be as described in a provisional patent application to Tate & Lyle, filed this same date, which is incorporated herein by reference. In one embodiment, the combustion chamber or boiler 12 is modular, i.e., is assembled off-site and shipped to the site of its intended use. In another embodiment, the combustion chamber is field-assembled.

The operation of the biomass energy recovery apparatus 10 is discussed below with reference to FIG. 1 and FIG. 2. The biomass fuel communicates, for example, pneumatically, or other conventional fuel feeding assembly, from the biomass supply 16 into the burner 14. The burner 14 intermixes air from the primary air supply 18 with the biomass fuel and communicates the intermixture into the flame containment portion or upper portion 20 of the boiler 12. The flame is ignited conventionally, such as with a natural gas ignition device. The burner 14 projects the flame downwardly along a longitudinal axis of the flame containment portion. Secondary air communicates through the inlet 22 into the wind box of the burner 14 for shaping the flame of the burning biomass. Tertiary air communicates through over-fire air nozzles, such as from a header or inlet 26 in communication with a supply of air, and stages the flame within the flame containment portion 20 of the boiler 12.

The combusting biomass fuel within the flame forms hot flue gas and entrained molten ash. The heat is given up or transferred substantially by radiation to the heat collection surfaces of the water tubes 62 that form the walls of the boiler 12. The tubes communicate the heat to the water in the tubes. The heated water forms steam that rises upwardly into the steam drum 28 where the steam is collected and communicated to other processes requiring the heated steam.

The hot flue gas is at a combustion temperature about the temperature of the flame. This temperature may differ depending on the biomass being combusted, but generally is in a range of between about 1500° C. to about 1800° C. As the heat from the hot flue gas transfers to the heat collection surface substantially by radiation, the temperature in the downstream hot flue gas becomes lower. The molten ash begins forming non-molten ash. A significant portion of the transfer of heat occurs prior to any substantial contact of molten ash to the heat collection surfaces. During the combustion and heat transfer, a portion of the ash is molten and a portion is non-molten. The molten ash will range during the processing from substantially entirely molten to substantially entirely non-molten, as the combusting biomass travels farther from the burner 14. The heat transfer yields a mixture of warm flue gas and non-molten ash, as the molten ash becomes non-molten ash. The warm flue gas is at a second temperature within a range from about an ash molten temperature to about an ash fusion temperature. The range of second temperatures is lower than the combustion temperature. Typically in the illustrated embodiment, the warm flue gas is at a temperature in range from about 1200° C. to about 760° C.

The mixture of the warm flue gas and non-molten ash continues downward movement, and heat continues to transfer to the heat collection surfaces. The temperature modulator communicating with the supply of the cold gas meters the cold gas into the combustion chamber proximate the exhaust opening 32. In the illustrated embodiment, the temperature modulator receives output air from the heat exchanger 41 and communicates the cool air through the inlet 48 into the combustion chamber. This cools the warm flue gas and yields a mixture containing cool flue gas and non-molten ash. The cool flue gas is at a third temperature in a range from about the ash fusion temperature and lower, for example in an extreme case, to about ambient temperature although typically to about 650° C. The third temperature is lower than the second temperature.

The cool flue gas changes directional flow from vertical to horizontal and communicates from the combustion chamber through the exhaust opening 32. The non-molten ash falls out of the laterally moving cool flue gas into the hopper 50. The auger conveyor 52 communicates the ash to the ash handling device 54, such as an ash collector, such as an ash treatment silo. The cool flue gas however includes some residual ash. The exhaust opening 32 communicates the cool flue gas to downstream processes, such as for example, selective catalytic reducers for scrubbing NOx, filtration assemblies for extraction of particulates and ash, and for use of residual heat.

In one embodiment a portion of the cool flue gas communicates to the heat exchanger 41. The residual heat in the cool flue gas can be applied, for example, in drying or heating processes, such as drying wet biomass fuel prior to communicating to the burner 14. The output from the heat exchanger is cold flue gas. The cold gas from the heat exchanger can be a supply for the temperature modulator discussed above.

Common sources of fiber for biomass fuels include grains of corn, wheat, rice, and other cereals, and stalks, leaves, and other vegetative matter of grasses, shrubs, and trees, such as cane or beets. Some biomass may be depleted of at least some carbohydrates, at least some oil, or both. In one embodiment, the fiber is derived from corn kernels wet-milled according to the process described in copending U.S. patent application Ser. No. 11/185,527, filed Jul. 20, 2005, which is hereby incorporated by reference. Other processes for the milling of corn kernels or other grains are also known. The fiber can be ground to produce particles of a relatively small, relatively uniform particle size and dried to a relatively low moisture content prior to performance of the method by techniques known in the art.

The biomass or fiber can be introduced 105 into the combustion chamber or boiler 12 through the burner 14, as described above. In one embodiment, the combustion chamber 12 is modular, i.e., is assembled off-site and shipped to the site of its intended use. In another embodiment, the combustion chamber is field-assembled.

In the present invention, fiber is the fuel burned in the combustion chamber and the oxidant can be oxygen, generally provided in the form of air, an oxygen/nitrogen mixture, or purified oxygen. The oxidant need not be oxygen. However, air is inexpensive and does not require special handling.

Typically, the fiber will contain some amount of nitrogen, primarily in any protein not extracted from the fiber between harvesting the plant and combustion of the fiber. Combustion of nitrogen-containing materials, using air or oxygen as the oxidant, will generate nitrogen oxides (NOx), such as nitric oxide and nitrous oxide, by reaction between nitrogen liberated from the material and oxygen. This is in addition to the generation of NOx by high-temperature reaction between nitrogen and oxygen both present in combustion air, if air is used as the oxidant. NOx emissions are undesirable under both custom and regulation in the developed world.

To bring about relatively low NOx production in combusting 110, in one embodiment, the combustion temperature can be from about 1500° C. to about 1800° C. Though some NOx is expected to form at these temperatures, it is generally less than the amount expected to form at either higher or lower temperatures. However, this temperature range presupposes relatively standard cereal grain fiber with a protein content of about 11% d.s.b. (corn fiber) to about 18% d.s.b. (wheat fiber) and a water content less than about 15 wt %.

In another embodiment, combustion is staged with substoichiometric levels of the oxidant (relative to the fuel) fed to the combustion chamber, leading to reduced formation of NOx and increased formation of $N_2$.

In addition to biomass and the oxidant, other materials or additives can be added to the burner during combustion. In one embodiment, the method further comprises adding a combustion additive into the burner during combusting. The combustion additive can be added at the tip of the flame so it is immediately ionized. A combustion additive is any material that enhances one or more properties of one or more combustion products.

In a further embodiment, the combustion additive is a material that modifies the properties of the ash, such as its melting point that can minimize or reduce slagging. There are several materials marketed under various trademarks which could be utilized. An example of such is CO-MATE® material available from Atlantic Combustion Technologies Inc., Amherst, NS. The combustion additive communicates through the inlet 27 and is metered by a controller that communicates with the sensor 27*a* that monitors NOx concentrations in the flue gas.

In another embodiment, the method further comprises adding a NOx reducing agent into the flame during combusting. The NOx reducing agent can be any simple nitrogenous compound, and in one embodiment the NOx reducing agent is selected from the group consisting of urea and ammonia. In one embodiment, adding the NOx reducing agent is performed when the furnace is at a temperature from about 925° C. to about 980° C., such as about 955° C. By doing so, NOx quantities in the warm flue gas can be reduced and NOx emissions lowered. This process is called selective non-catalytic reduction (SNCR).

Although NOx emissions may be lowered by one or more of the techniques described above, some NOx may still be present in the flue gas and can be treated by a NOx abatement system (e.g., SCR).

The combusting step 110 yields a hot flue gas, molten ash, and possibly bottoms ash. (Molten ash may also be referred to as tacky ash. Bottom ash and fly-ash may also be referred to as non-molten ash or non-tacky ash). The bottom ash can be recovered for disposal or reuse, as will be discussed in more detail below. The hot flue gas contains energy which, if captured, could be used to power or partially power various processes, such as a grain milling process that produces fiber as a byproduct, for example, the grain milling process described in U.S. patent application Ser. No. 11/185,527, discussed above. In one embodiment, "hot" refers to a temperature in the range from about 300° C. greater than the fusion point of the ash to the flame temperature. However, the molten ash, if it were to contact a metal surface within the firebox, a boiler, or other structures, would over time form a slag on that metal surface that would lead to corrosion (and subsequent downtime and expense for repair or replacement of corroded materials) and, if heat transfer were intended to occur across that metal surface, would reduce the efficiency of heat transfer.

In the transferring step 120, heat from the hot flue gas is transferred to at least a portion of a heat-transfer apparatus, such as a water wall (an area formed by pipes containing a heat-transfer medium, such as water), substantially by radiation prior to any contact of the molten ash to a surface of the combustion chamber, to yield a warm flue gas and a non-molten ash. "Warm" in this context refers to a temperature lower than that of the hot flue gas generated by combustion. In one embodiment, the warm flue gas is at a temperature from about the fusion point of the ash to about the melting point of the ash and below the combustion temperature. In one embodiment, the warm flue gas is at a temperature from about the fusion point of the ash 300° C. greater than the fusion point of the ash. As is known, radiation involves infrared emission by molecules of a hotter material (in this case, the hot flue gas) and infrared absorption by molecules of a colder one (in this case, the outer wall(s) of the heat-transfer apparatus, which then conduct(s) heat to the heat-transfer medium flowing therein). A small amount of heat (typically, less than about 5% of the heat generated by the combusting step 110) can be transferred by conduction or convection. The heat-transfer medium can then be used to transfer heat to other apparatus which can convert heat to useful work, such as a steam heater or a turbine, among others. Contact of the molten ash to a surface of the combustion chamber, especially if such surface is made of metal, prior to radiative heat transfer would result in slagging and the undesirable effects discussed above. Another desirable outcome of heat transfer via radiation is the cooling of the hot flue gas (typically at a temperature from about 1500° C. to about 1800° C.) to a warm flue gas (typically at a temperature in a range from about 760° C. to less than about 1200° C.), at which temperature a major portion of the ash is typically rendered non-molten. The non-molten ash is substantially inert with respect to metal and does not form a slag on interior surfaces of the firebox or other equipment. However, some molten ash may remain entrained in the warm flue gas after the transferring step 120. That said, the amount of molten ash entrained in the warm flue gas after the transferring step 120 will be less than the amount of molten ash entrained in the hot flue gas generated by the combusting step 110.

After heat transfer, the warm flue gas is cooled 130 with cold gas, to yield a mixture containing cool flue gas and non-molten ash. "Cool" in this context refers to a temperature lower than that of the warm flue gas but higher than that of the cold gas. The cold gas can be provided as flue gas returned from subsequent downstream processing, such as from the heat exchanger 41 or other processing. Other cold gas, such as ambient air, can be used. Cooling 130 further reduces the temperature of the warm flue gas and further increases the non-molten ash content relative to that yielded by the transferring step 120. In other words, the amount of molten ash entrained in the cool flue gas after the cooling step 130 will be less than the amount of molten ash entrained in the warm flue gas generated by the transferring step 120. In one embodiment, cooling 130 yields substantially no molten ash, i.e., substantially all ash is non-molten.

After cooling 130, other steps can be performed, if desired. Ash recovery can be performed using a dust collector, electrostatic precipitation, or a wet scrubber, among other techniques and apparatus. Non-molten ash generally contains phosphorous and may contain calcium, magnesium, sodium, or potassium. The non-molten ash can be discarded. To minimize disposal costs and maximize value, the non-molten ash can be reused as a fertilizer, a land filling material, or a component of a phosphatic cement, among other uses.

The exit temperature of the cool flue gas after primary heat recovery and NOx abatement is typically about 650° C. The cool flue gas may contain volatile chlorides and SOx. The cool flue gas can be vented to a flue stack or otherwise processed, such as by a second heat transfer step. In one embodiment, the cool flue gas undergoes a second cooling step to yield a cold flue gas that can be returned for use as the cold gas in cooling step 130. In one embodiment, the cooled flue gas may be suitable for drying non-dry cereal processing products (e.g., Corn Gluten Meal), because the temperature of the cooled flue gas is typically in the required range for drying these types of products (150° C. to 400° C.). After drying, the exit gas is "wet scrubbed" to remove residual volatile gases and fly ashes, thus removing volatile chlorides and SOx, if contained in the NOx abated gas, using the same standard equipment, to provide a cost effective way to achieve low emission levels of these volatiles. The exit gas, after drying and wet scrubbing, may be termed "cold flue gas."

In one embodiment, the warm flue gas has a temperature less than about 1200° C., the cool flue gas has a temperature less than about 650° C., and the cold flue gas has a temperature less than about 600° C.

In one embodiment, a cool flue gas stream at about 340° C. may be used to preheat the air entering the combustion chamber. In another embodiment, the combustion chamber air can be preheated using other low temperature (e.g., 200° C.) waste gas streams which are recoverable from a cereal processing refinery. In one embodiment, the waste gas stream is a cold flue gas yielded by drying and wet scrubbing of cool flue gas.

This use of the NOx abated cool flue gas from the combustion chamber avoids the necessity for drying a cereal processing product using a gas stream that has been preheated using a specific energy source such as natural gas or other fossil fuels. The typical energy savings by the use of the approach outlined above would reduce the energy required for drying the cereal processing product by about 50% and would further reduce the carbon footprint of a cereal processing plant.

Returning to NOx abatement, in one embodiment, NOx in the flue gas can be quantified by techniques known in the art. This may be useful in complying with emissions regulations in various jurisdictions. In addition, quantifying NOx in the flue gas can provide information, either to the operator or a control device, to enable adjustment of the combustion temperature to reduce the quantity of NOx produced and thence subsequent NOx levels in the flue gas after heat transfer and cooling being routed to the flue stack or other further processing.

In one embodiment, the method further comprises scrubbing NOx from the flue gas. NOx scrubbing can be performed using techniques and apparatus known in the art for removing NOx from gas streams, such as a selective catalytic reduction (SCR).

The following examples are included to demonstrate embodiments of the invention. It should be appreciated by those of skill in the art that the techniques disclosed in the examples which follow represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

As will be known to a person skilled in the art, the analyses included in the following examples may vary depending on the conditions in the soil, air and water at the time the crops or vegetation were grown, as well as the moisture content of the biomass fuel at the time the biomass fuels is used as an energy source.

EXAMPLES

Example 1

Whole wheat grain was dry milled and sieved to generate two product streams: flour and wheat fiber. Typical properties of the wheat fiber are summarized in Table 1. The wheat fiber was burned in a suspension burner and the heat was recovered. The exhaust gases were analysed and burn conditions could be achieved which would allow BACT (Best Available Control Technology) abatement methodologies to be used successfully on this material.

TABLE 1

| | Reporting Basis | | |
|---|---|---|---|
| | As Rec'd | Dry | Air Dry |
| Proximate (%) | | | |
| Moisture | 11.70 | 0.00 | 11.70 |
| Ash | 3.59 | 4.07 | 3.59 |
| Volatile | 68.24 | 77.28 | 68.24 |
| Fixed C | 16.47 | 18.65 | 16.47 |
| Total | 100.00 | 100.00 | 100.00 |
| Sulfur | 0.18 | 0.20 | 0.18 |
| Btu/lb (HHV) | 7401 | 8381 | 7401 |
| MMF Btu/lb | 7698 | 8766 | |
| MAF Btu/lb | | 8737 | |
| Ultimate (%) | | | |
| Moisture | 11.70 | 0.00 | 11.70 |
| Carbon | 42.28 | 47.88 | 42.28 |
| Hydrogen | 5.46 | 6.18 | 5.46 |
| Nitrogen | 2.56 | 2.90 | 2.56 |
| Sulfur | 0.18 | 0.20 | 0.18 |
| Ash | 3.59 | 4.07 | 3.59 |
| Oxygen* | 34.23 | 38.77 | 34.23 |
| Total | 100.00 | 100.00 | 100.00 |
| Chlorine | 0.052 | 0.059 | 0.052 |

| Elemental Analysis of Ash (%) | |
|---|---|
| $SiO_2$ | 4.00 |
| $Al_2O_3$ | 0.08 |
| $TiO_2$ | 0.02 |
| $Fe_2O_3$ | 0.39 |
| CaO | 3.09 |
| MgO | 10.70 |
| $Na_2O$ | 0.25 |
| $K_2O$ | 31.10 |
| $P_2O_5$ | 45.54 |
| $SO_3$ | 0.91 |
| Cl | 0.04 |
| $CO_2$ | 0.43 |
| Total | 96.55 |

TABLE 1-continued

| Ash Fusion Temperatures (Deg F.) | | |
|---|---|---|
| | Oxidizing Atmosphere | Reducing Atmosphere |
| Initial | 1500 | 1597 |
| Softening | 1596 | 1652 |
| Hemispherical | 1626 | 1700 |
| Fluid | 1660 | 1735 |

Lb. Alkali/MM Btu = 1.52
Lb. Ash/MM Btu = 4.85
Lb. SO2/MM Btu = 0.49
*Oxygen by Difference.
Note:
The ash was calcined @ 1110° F. (600° C.) prior to analysis

Example 2

High carbohydrate corn fiber derived from normal corn wet milling process was burned in a suspension burner. Properties of the biomass boiler feed, the exhaust gases generated and the resulting ash are summarized in Table 2.

TABLE 2

| | Reporting Basis | | |
|---|---|---|---|
| | As Rec'd | Dry | Air Dry |
| Proximate (%) | | | |
| Moisture | 12.31 | 0.00 | 12.31 |
| Ash | 1.34 | 1.53 | 1.34 |
| Volatile | 69.79 | 79.59 | 69.79 |
| Fixed C | 16.56 | 18.88 | 16.56 |
| Total | 100.00 | 100.00 | 100.00 |
| Sulfur | 0.25 | 0.29 | 0.25 |
| Btu/lb (HHV) | 7389 | 8426 | 7389 |
| MMF Btu/lb | 7495 | 8567 | |
| MAF Btu/lb | | 8557 | |
| Ultimate (%) | | | |
| Moisture | 12.31 | 0.00 | 12.31 |
| Carbon | 43.39 | 49.48 | 43.39 |
| Hydrogen | 5.35 | 6.10 | 5.35 |
| Nitrogen | 1.93 | 2.20 | 1.93 |
| Sulfur | 0.25 | 0.29 | 0.25 |
| Ash | 1.34 | 1.53 | 1.34 |
| Oxygen* | 35.43 | 40.40 | 35.43 |
| Total | 100.00 | 100.00 | 100.00 |
| Chlorine | 0.039 | 0.044 | 0.039 |

| Elemental Analysis of Ash (%) | |
|---|---|
| $SiO_2$ | 12.56 |
| $Al_2O_3$ | 3.22 |
| $TiO_2$ | 0.13 |
| $Fe_2O_3$ | 1.44 |
| CaO | 1.94 |
| MgO | 12.50 |
| $Na_2O$ | 1.65 |
| $K_2O$ | 28.50 |
| $P_2O_5$ | 31.64 |
| $SO_3$ | 5.37 |
| Cl | 0.21 |
| $CO_2$ | 0.54 |
| Total | 99.70 |

TABLE 2-continued

| Ash Fusion Temperatures (Deg F.) | | |
|---|---|---|
| | Oxidizing Atmosphere | Reducing Atmosphere |
| Initial | 2420 | 2258 |
| Softening | 2446 | 2292 |
| Hemispherical | 2469 | 2372 |
| Fluid | 2517 | 2456 |

Lb. Alkali/MM Btu = 0.55

Lb. Ash/MM Btu = 1.81

Lb. SO2/MM Btu = 0.68

*Oxygen by Difference.

Note:

The ash was calcined @ 1110° F. (600° C.) prior to analysis

Example 3

A low carbohydrate corn fiber produced as described in co-pending U.S. patent application Ser. No. 11/185,527 was burnt in a suspension burner. Properties of the biomass boiler feed, the exhaust gases generated and the resulting ash are summarized in Table 3.

TABLE 3

| | Reporting Basis | | |
|---|---|---|---|
| | As Rec'd | Dry | Air Dry |
| Proximate (%) | | | |
| Moisture | 4.50 | 0.00 | 4.50 |
| Ash | 1.12 | 1.17 | 1.12 |
| Volatile | 75.82 | 79.39 | 75.82 |
| Fixed C | 18.56 | 19.44 | 18.56 |
| Total | 100.00 | 100.00 | 100.00 |
| Sulfur | 0.25 | 0.26 | 0.25 |
| Btu/lb (HHV) | 8332 | 8725 | 8332 |
| MMF Btu/lb | 8433 | 8836 | |
| MAF Btu/lb | | 8828 | |
| Ultimate (%) | | | |
| Moisture | 4.50 | 0.00 | 4.50 |
| Carbon | 48.29 | 50.57 | 48.29 |
| Hydrogen | 6.42 | 6.72 | 6.42 |
| Nitrogen | 1.70 | 1.78 | 1.70 |
| Sulfur | 0.25 | 0.26 | 0.25 |
| Ash | 1.12 | 1.17 | 1.12 |
| Oxygen* | 37.72 | 39.50 | 37.72 |
| Total | 100.00 | 100.00 | 100.00 |
| Chlorine | 0.067 | 0.070 | 0.067 |

| Elemental Analysis of Ash (%) | |
|---|---|
| $SiO_2$ | 7.28 |
| $Al_2O_3$ | 0.65 |
| $TiO_2$ | 0.10 |
| $Fe_2O_3$ | 1.40 |
| CaO | 3.69 |
| MgO | 9.05 |
| $Na_2O$ | 26.10 |
| $K_2O$ | 11.60 |
| $P_2O_5$ | 28.33 |
| $SO_3$ | 11.00 |
| Cl | 2.39 |
| $CO_2$ | 0.22 |
| Total | 101.81 |

TABLE 3-continued

| Ash Fusion Temperatures (Deg F.) | | |
|---|---|---|
| | Oxidizing Atmosphere | Reducing Atmosphere |
| Initial | 1913 | 2618 |
| Softening | 1930 | 2638 |
| Hemispherical | 1946 | 2640 |
| Fluid | 1957 | 2645 |

Lb. Alkali/MM Btu = 0.51

Lb. Ash/MM Btu = 1.34

Lb. SO2/MM Btu = 0.60

*Oxygen by Difference.

Note:

The ash was calcined @ 1110° F. (600° C.) prior to analysis

Example 4

Whole ground corn was hammer milled to produce a finely ground feed. This feed was burned in a suspension burner. Properties of the biomass boiler feed, the exhaust gases generated and the resulting ash are summarized in Table 4.

TABLE 4

| | Reporting Basis | | |
|---|---|---|---|
| | As Rec'd | Dry | Air Dry |
| Proximate (%) | | | |
| Moisture | 12.67 | 0.00 | 12.67 |
| Ash | 1.78 | 2.04 | 1.78 |
| Volatile | 70.55 | 80.79 | 70.55 |
| Fixed C | 15.00 | 17.17 | 15.00 |
| Total | 100.00 | 100.00 | 100.00 |
| Sulfur | 0.10 | 0.11 | 0.10 |
| Btu/lb (HHV) | 7105 | 8135 | 7105 |
| MMF Btu/lb | 7243 | 8318 | |
| MAF Btu/lb | | 8305 | |
| Ultimate (%) | | | |
| Moisture | 12.67 | 0.00 | 12.67 |
| Carbon | 41.19 | 47.17 | 41.19 |
| Hydrogen | 5.45 | 6.24 | 5.45 |
| Nitrogen | 1.24 | 1.42 | 1.24 |
| Sulfur | 0.10 | 0.11 | 0.10 |
| Ash | 1.78 | 2.04 | 1.78 |
| Oxygen* | 37.57 | 43.02 | 37.57 |
| Total | 100.00 | 100.00 | 100.00 |
| Chlorine | 0.036 | 0.041 | 0.036 |

| Elemental Analysis of Ash (%) | |
|---|---|
| $SiO_2$ | 3.67 |
| $Al_2O_3$ | 0.22 |
| $TiO_2$ | 0.04 |
| $Fe_2O_3$ | 0.33 |
| CaO | 15.20 |
| MgO | 9.88 |
| $Na_2O$ | 0.19 |
| $K_2O$ | 24.50 |
| $P_2O_5$ | 41.53 |
| $SO_3$ | 1.89 |
| Cl | 0.05 |
| $CO_2$ | 3.10 |
| Total | 100.60 |

TABLE 4-continued

| Ash Fusion Temperatures (Deg F.) | | |
|---|---|---|
| | Oxidizing Atmosphere | Reducing Atmosphere |
| Initial | 1963 | 2010 |
| Softening | 1979 | 2043 |
| Hemispherical | 1994 | 2085 |
| Fluid | 2017 | 2100 |

Lb. Alkali/MM Btu = 0.62
Lb. Ash/MM Btu = 2.51
Lb. SO2/MM Btu = 0.28
*Oxygen by Difference.
Note:
The ash was calcined @ 1110° F. (600° C.) prior to analysis The apparatus and methods disclosed herein can be made and executed without undue experimentation in light of the present disclosure. While the apparatus of this invention have been described in terms of preferred embodiments, it will be apparent to those of skill in the art that variations may be applied to the apparatus and in the method steps or in the sequence of steps thereof described herein without departing from the concept, spirit and scope of the invention. All such similar substitutes and modifications apparent to those skilled in the art are deemed to be within the spirit, scope and concept of the invention as defined by the appended claims.

What is claimed is:

1. An apparatus that extracts energy from biomass fuel or fiber, comprising:

a vertically elongated combustion chamber having a top end, a flame containment portion, and a lower end portion;

a supply of a biomass fuel for combusting in the combustion chamber;

at least one suspension burner mounted at the top end of the combustion chamber and communicating with the supply of the biomass fuel, the burner configured for projecting a flame down a longitudinal axis of the flame containment portion of the combustion chamber;

a wall of the combustion chamber defining a heat transfer apparatus having at least a portion of a heat collection surface located radially from the flame; and an exhaust opening in a side wall of the combustion chamber vertically spaced from a distal end of the flame containment portion and vertically spaced lower of a substantial majority of the heat collection surface, whereby the biomass fuel combusted within the combustion chamber yields a mixture containing hot flue gas and entrained molten ash above the exhaust opening, the hot flue gas at about a combustion temperature that is about the temperature of the flame, with heat from the hot flue gas transferring to the heat collection surface substantially by radiation to yield a mixture of warm flue gas and non-molten ash, the warm flue gas at a second temperature in a range from about an ash fusion temperature to about an ash molten temperature, the range lower than the combustion temperature;

a temperature modulator that communicates with a supply of a cold air or gas and meters the cold air or gas into the combustion chamber proximate to the exhaust opening, to cool the warm flue gas and yield a mixture containing cool flue gas and non-molten ash, the cool flue gas at third temperature in a range from ambient temperature to about the ash fusion temperature, the third temperature lower than the second temperature, which cool flue gas communicates from the combustion chamber through the exhaust opening.

2. The apparatus as recited in claim 1, further comprising a heat exchanger having an inlet that communicates with the exhaust opening for receiving cool flue gas and having an outlet that communicates with the temperature modulator as the supply of the cold gas.

3. The apparatus as recited in claim 1, wherein the flame containment portion is sized for combusting the biomass fuel prior to any substantial contact of fly-ash to a surface of the combustion chamber.

4. The apparatus as recited in claim 1, wherein the combustion chamber is modular for shop-build manufacture at a first site and transport as a unitary body to a second site for installation.

5. The apparatus as recited in claim 1, wherein the combustion temperature of the biomass fuel within the flame is from about 1500° C. to about 1800° C.

6. The apparatus as recited in claim 1, wherein the warm flue gas has a temperature in a range of about 1200° C. to about 760° C.

7. The apparatus as recited in claim 6, wherein the cool flue gas has a temperature less than about 650° C.

8. The apparatus as recited in claim 6, wherein the cold gas has a temperature of less than about 600° C.

9. The apparatus as recited in claim 1, further comprising a sensor to monitor the quantity of NOx in the warm flue gas.

10. The apparatus as recited in claim 9, wherein a quenching gas is metered for insertion into the combustion chamber for adjusting the combustion temperature to reduce the formation of slag and ash buildup.

11. The apparatus as recited in claim 1, further comprising an inlet to the combustion chamber communicating with a supply of a combustion additive selectively added to modify the melting properties of the ash to reduce slagging.

12. The apparatus as recited in claim 1, further comprising an inlet to the combustion chamber for introducing a reducing agent to reduce the quantity of NOx in the warm flue gas.

13. The apparatus as recited in claim 12, wherein the reducing agent comprises a simple nitrogenous compound.

14. The apparatus as recited in claim 12, wherein the reducing agent is selected from the group consisting of urea and ammonia.

15. The apparatus as recited in claim 14, further comprising a reburn injector that communicates non-molten ash from the collection device into the biomass fuel supply or into the flame within the combustion chamber.

16. The apparatus as recited in claim 1, further comprising a hopper in a lower portion of the combustion chamber that receives non-molten ash, the hopper having an outlet for communicating non-molten ash to collection device.

17. The apparatus as recited in claim 1, further comprising a reducer that receives the cool flue gas from the exhaust opening and removes a portion of the NOx therefrom.

18. The apparatus as recited in claim 17, wherein the reducer is a selective catalytic reducer.

19. The apparatus as recited in claim 1, wherein the supply of the cold gas is recirculated cool flue gas communicated from the exhaust opening.

20. A method for extracting energy from a biomass fuel, comprising the steps of:

(a) introducing a biomass fuel through a burner attached to a top end of a vertically elongated combustion chamber, the burner configured for projecting a flame down a longitudinal axis of a flame containment portion of the combustion chamber;

(b) combusting the biomass fuel within a flame in the flame containment portion of the combustion chamber to yield a mixture containing hot flue gas and entrained molten ash;

(c) transferring heat from the hot flue gas to a heat transfer apparatus having at least a portion of a heat collection surface located radially from the flame in the flame containment portion of the combustion chamber substantially by radiation prior to any substantial contact of molten ash to a surface of the combustion chamber to yield a mixture of warm flue gas and non-molten ash, the warm flue gas at a second temperature in a range from about an ash fusion temperature to about an ash molten temperature, the range lower than the combustion temperature;

(d) inserting into the combustion chamber a cold gas proximate an exhaust opening in a side wall of the combustion chamber vertically spaced from a distal end of the flame containment portion and vertically spaced lower then a substantial majority of the heat collection surface, the cold gas to cool the warm flue gas and yield a mixture containing cool flue gas and non-molten ash, the cool flue gas at a third temperature in a range from ambient temperature to about the ash fusion temperature, the third temperature lower than the second temperature; and (e) communicating the cool flue gas from the combustion chamber through the exhaust opening.

21. The method as recited in claim 20, further comprising the step of communicating at least a portion of the cool flue gas to a heat exchanger that yields a gas for a supply of the cold gas to the temperature modulator.

22. The method as recited in claim 20, further comprising the step of shop-building the combustion chamber as a modular unit at a first site for transport as a unitary body to a second site for installation.

23. The method as recited in claim 20, wherein the combustion temperature of the biomass fuel within the flame is from about 1500° C. to about 1800° C.

24. The method as recited in claim 20, further comprising the step of communicating a quenching material into the combustion chamber for adjusting the combustion temperature to reduce slag and ash buildup.

25. The method as recited in claim 24, further comprising the step of metering the supply of quenching material communicated into the combustion chamber in response to a control sensor configured to monitor the quantity of NOx in the warm flue gas.

26. The method as recited in claim 20, further comprising the step of communicating a combustion additive into the burner to reduce slag and ash buildup.

27. The method as recited in claim 26, further comprising communicating a reducing agent from a supply through an inlet into the combustion chamber for reducing the quantity of NOx in the warm flue gas.

28. The method as recited in claim 27, wherein the reducing agent comprises a simple nitrogenous compound.

29. The method as recited in claim 27, wherein the reducing agent is selected from the group consisting of urea and ammonia.

30. The method as recited in claim 29, wherein the warm flue gas has a temperature in a range of about 1200° C. to about 760° C.

31. The method as recited in claim 30, wherein the cool flue gas has a temperature less than about 650° C.

32. The method as recited in claim 31, wherein the cold gas has a temperature of less than about 600° C.

33. The method as recited in claim 20, further comprising the step of reducing a portion of the NOx in the cool flue gas after communication from the exhaust opening.

34. The method as recited in claim 33, wherein the step of reducing comprises passing the cool flue gas through a selective catalytic reducer.

35. The method as recited in claim 20, further comprising the step of collecting in a hopper in a lower portion of the combustion chamber non-molten ash.

36. The method as recited in claim 35, the hopper having an outlet for communicating non-molten ash to a collection device.

37. The method as recited in claim 36, further comprising the step of injecting non-molten ash from the collection device into the biomass fuel supply or into the flame within the combustion chamber.

* * * * *